United States Patent [19]

Veenman et al.

[11] Patent Number: 4,601,393

[45] Date of Patent: Jul. 22, 1986

[54] STACKABLE CARRIER OR CRATE FOR GOODS OR ARTICLES

[75] Inventors: Simon J. M. Veenman, 's-Gravenzande; Coenraad J. B. M. Benraad, Dedemsvaart, both of Netherlands

[73] Assignee: Simon J. M. Veenman, Maasdijk, Netherlands

[21] Appl. No.: 661,460

[22] Filed: Oct. 16, 1984

[30] Foreign Application Priority Data

Oct. 17, 1983 [NL] Netherlands ..... 8303572

[51] Int. Cl.[4] ..... B65D 21/04

[52] U.S. Cl. ..... 206/505; 206/507; 206/509; 206/511

[58] Field of Search ..... 206/505, 507, 509, 511

[56] References Cited

U.S. PATENT DOCUMENTS

| | | | |
|---|---|---|---|
| 2,563,330 | 8/1951 | Gimbal | 206/511 |
| 3,338,466 | 8/1967 | Hare | 206/507 |
| 3,887,073 | 6/1975 | Wilson | 206/511 |
| 4,441,615 | 4/1984 | Goodrich | 206/505 |

FOREIGN PATENT DOCUMENTS

| | | | |
|---|---|---|---|
| 2524863 | 10/1983 | France | 206/507 |

*Primary Examiner*—George E. Lowrance

*Attorney, Agent, or Firm*—Wilkinson, Mawhinney & Theibault

[57] ABSTRACT

A rectangular or square stackable plastic carrier, more particularly a plastic crate, comprises a support bottom part 1 formed of a bottom 2 with an upright edge 3 at its periphery.

Corner columns 4 are able to fit at their top end and bottom end respectively, into the bottom and top side of a carrier disposed thereon and therebeneath.

The length H of the corner columns is a multiple of the height h of the bottom part 1.

The external distance $L_1$ between two opposite set-back sides 5 of the bottom part 1 is substantially equal to or less than the internal distance $L_2$ between two corner columns measured between the same opposite set-back sides 5, said set-back sides being provided with a handle 6. The set-back part 5 corresponds to the transverse dimension of a corner column. In the space between two corner columns 4 and the set-back part 5 free ends of corner columns of a carrier being therebeneath in a staggered relationship, may be received.

The short side of the carrier or crate is preferably at least (the multiple/2+1) times the column width B and the long side is preferably at least equal to the width of the crate+(the multiple/2−1) times the column width B.

The construction of the carriers allows an easy stacking or nesting of carriers in a staggered position.

9 Claims, 3 Drawing Figures

STACKABLE CARRIER OR CRATE FOR GOODS OR ARTICLES

BACKGROUND OF THE INVENTION

The present invention relates to a stackable carrier for goods or articles, more particularly a plastic crate, comprising a support bottom part with corner columns which fit, at their top and bottom ends respectively, into the bottom and top respectively of a correspondingly shaped carrier or crate disposed respectively thereon or therebeneath.

Stackable carriers of this type are known per se. Their corner columns form a relatively rigid construction to enable the force and weight of the goods in the stacked carriers to be received. A support bottom sometimes comprises upright columns projecting above the support bottom part.

Irrespective of the construction of the stackable carriers, there is always the problem that they have to occupy a minimum amount of space when empty while, when in use, they should enable the largest possible quantity of goods or articles to be accommodated in a minimum amount of space.

To prevent empty carriers from occupying a considerable amount of space, attempts have been made to find various solutions, e.g. to nest box-shaped carriers into each other or to place shallower carriers alternately crosswise on a preceding carrier to allow a more compact stacking of empty carriers. An example of this latter construction is described in U.S. Pat. No. 3,675,815, issued to Houston REHRIG, on July 11, 1972. In this Patent Specification two long side walls of the bottom part of the carrier are low with respect to the other walls thereof, so as to provide space to accommodate a carrier placed transversely thereon. Although this feature does provide some saving of space with stacked carriers, the total volume of empty carriers stacked upon each other is still considerable, because the space occupied by the even and uneven stacked carriers still corresponds to that of full carriers.

SUMMARY OF THE INVENTION

It is a main object of the present invention to provide a novel stackable carrier, more particularly a plastic crate, with which a relatively large number of empty crates can be stacked in 90°-offset positions in respect of each other within the operative dimensions of the crates when they are used for carrying goods or articles.

This is attained according to the present invention, by a stackable carrier of the kind indicated herebefore the length of the corner columns of which being a multiple of the height of the support bottom part at the point where another carrier or crate can rest transversely on the top edge of said bottom part between the corner columns.

In an embodiment of the present invention the support bottom part is provided with a set-back part, at least at two opposite sides near each column, each set-back part corresponding at least to the transverse dimensions of a column situated at that point.

According to the invention the upright columns and the support bottom part are made as a single plastic moulding, the columns on opposite sides being so disposed externally against the support bottom part that there is space available adjacent the columns at these opposite sides to receive free column ends of a carrier or crate disposed therebeneath in staggered relationship.

In one practical embodiment, the stackable carrier according to the invention is so constructed that the external distance between two opposite sides of the bottom part adjacent the corner columns is practically equal to or less than the internal distance between two corner columns measured between the same opposite sides. Consequently, when empty carriers are stacked alternately crosswise, even carriers or crates can be situated with their columns in the same plane but in staggered relationship adjacent each other. The same applies to uneven carriers or crates, so that it is possible in this way not only to stack a large number of empty carriers or crates on one another within a given column height, but also the column of stacked empty carriers or crates is stable.

In the case of carriers or crates in which the base of the bottom part has a rectangular pattern, the above effect is achieved as a result of the feature that the short side is at least (the multiple/2+1) times the column width and the long side is at least equal to the width of the crate+(the multiple/2−1) times the column width. In this way, the carriers can be stacked one upon the other very compactly in the case of transportation or storage when empty, and a space saving of 60% can be obtained even with a given vehicle height, e.g. of 2.20 m load height. The dimensions of the base of the bottom part remain in this case still adapted to the dimensions of platforms or pallets. The goods can be retained on the support bottom between the columns, for example, by means of loose packing sheets e.g. of plastic or corrugated cardboard, or by wrapping the complete unit in shrink-film. Stacks of empty carriers can also be wrapped with a shrink film, e.g. for sending them to a carrier purchaser.

SURVEY OF THE DRAWINGS

DESCRIPTION OF THE PREFERRED EMBODIMENTS

Figure 1:
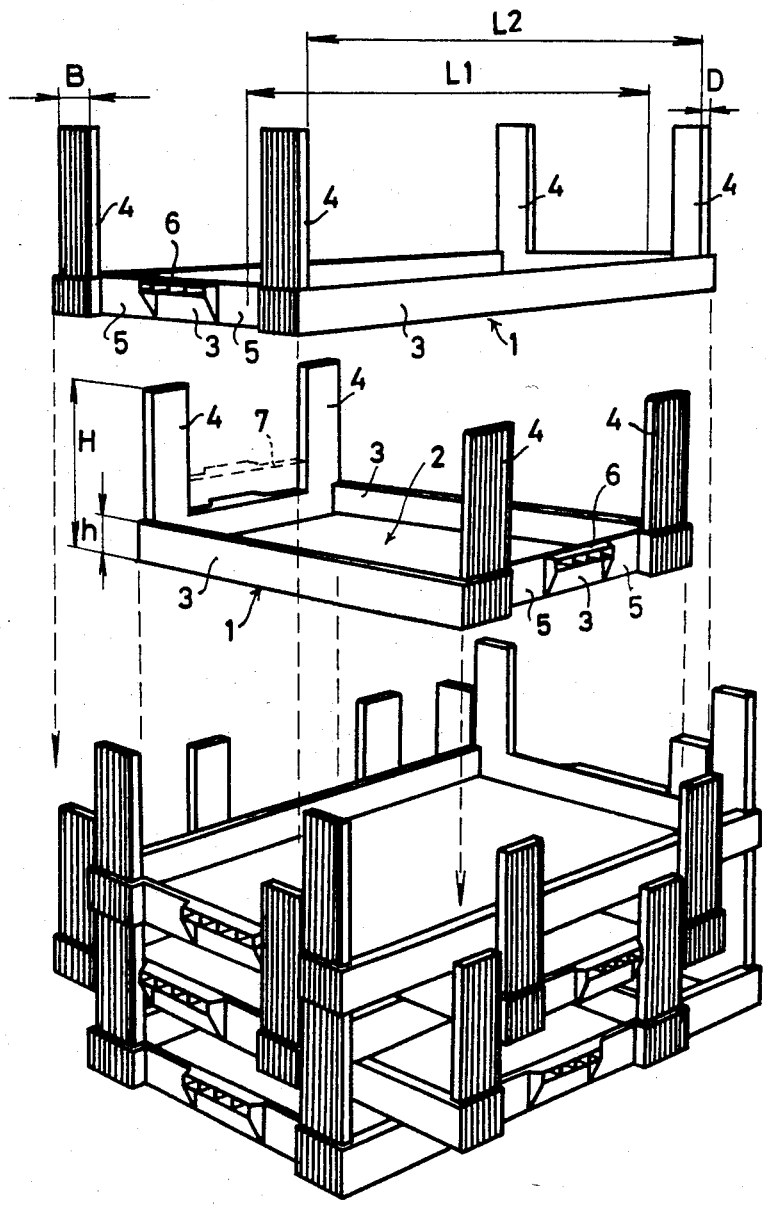
FIG. 1 is a perspective view of carriers or crates disposed one inside the other, with two carriers in a next position at some distance thereabove.
Figure 2:
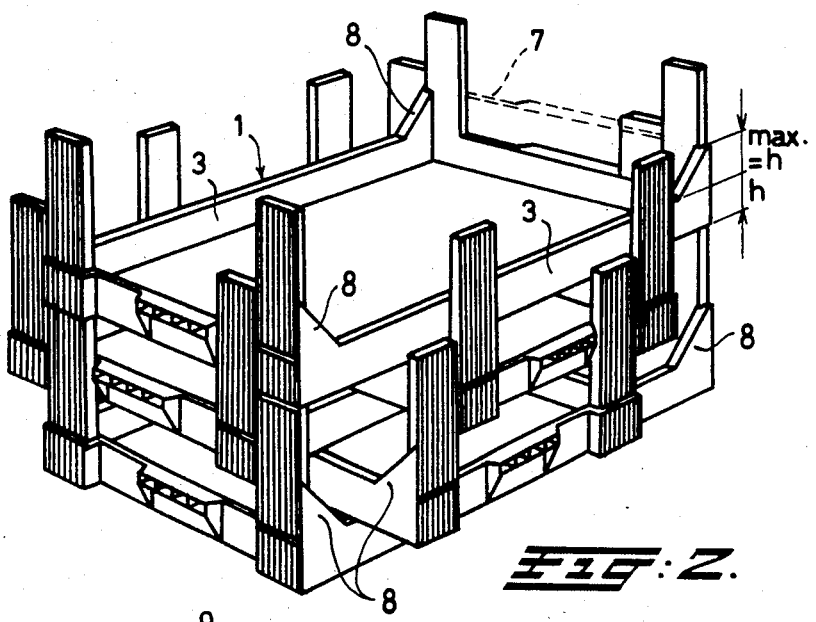
FIG. 2 is a similar perspective view of the support bottom part of FIG. 1, the columns being provided with an additional support surface.

FIG. 1 shows a number of stackable carriers for goods or articles, more particularly plastic crates, turned through 90° relatively to each other and alternately placed one upon the other. Each carrier comprises a support bottom part 1 formed of a bottom 2 with an upright edge 3 at its periphery. The support bottom part 1 is provided with corner columns 4. At their top and bottom ends the corner columns fit respectively into the bottom and top side of a matching carrier disposed respectively thereon or therebeneath.

The corner columns of the carriers or crates are provided, at the bottom, with connecting parts which can engage around the top ends of the columns of a similar carrier disposed therebeneath. Though this is not shown in detail in the drawing because it is known per se in connection with corner columns for stackable carriers, it is mentioned in respect of a special feature which will be described hereafter. As is apparent from the drawing, the length H of the corner column is a multiple of the height h of the support bottom part 1, more particularly at the point where another carrier can rest transversely on the top edge of said part between the corner columns.

The method of stacking as illustrated is possible because the external distance $L_1$ between two opposite sides of the bottom part 1 adjacent the corner columns 4 is practically equal to or less than the internal distance $L_2$ between two corner columns measured between the same opposite sides. By the term "practically equal" is meant that a small dimensional deviation may occur which may be due to the columns getting loose or a slight reduction of the distance L−1 in order to enable the corner columns 4 to slide along the side at this point without any jamming of a carrier occurring. The part adjacent the corner columns to which the distance $L_1$ is denoted by the reference numerals 5. At the opposite sides of the support bottom parts 5 form set-back parts near each column, each set-back part corresponding to the transverse dimension of a column 4 situated there. The set-back part(s) 5 may extend continuously from each opposite side of one column 4 to the other column 4. The carrier or crate illustrated comprises a support bottom part 1 with upright columns 4 near the corners, the upright columns 4 and the support bottom part 1 being manufactured as a single plastic moulding, columns 4 being so disposed externally at the opposite sides against part 1 that there is space available next to the columns at these opposite sides to receive free column ends of a carrier or crate situated therebeneath in staggered relationship (see the bottom part of FIG. 1). The columns 4 have a rectangular cross-section and their maximum transverse dimension is parallel to those sides or edges 3 of part 1 where the set-back parts 5 are disposed.

The method of stacking empty carriers as illustrated is possible because of the base or bottom 2 of part 1 having a rectangular pattern, the short side being at least (the multiple/2+1)times the column width. The column width is denoted by letter B. The long side is at least equal to the width of the crate+(the multiple/2−1) times the column width B.

As already described hereinbefore, the support bottom part 1 is provided with an upright edge 3 and in addition to the base 2 these upright edges also have set-back parts 5. A handle part 6 is preferably disposed in the center between the columns 4 at the set-back part 5 of the upright edge 3. The distance between the handle part 6 and a column 4 is almost equal to or larger than the transverse dimension B of a column measured in the same direction. Instead of the handle part 6, naturally, the upright edge may be formed with openings to enable the carrier to be handled.

Figure 3:
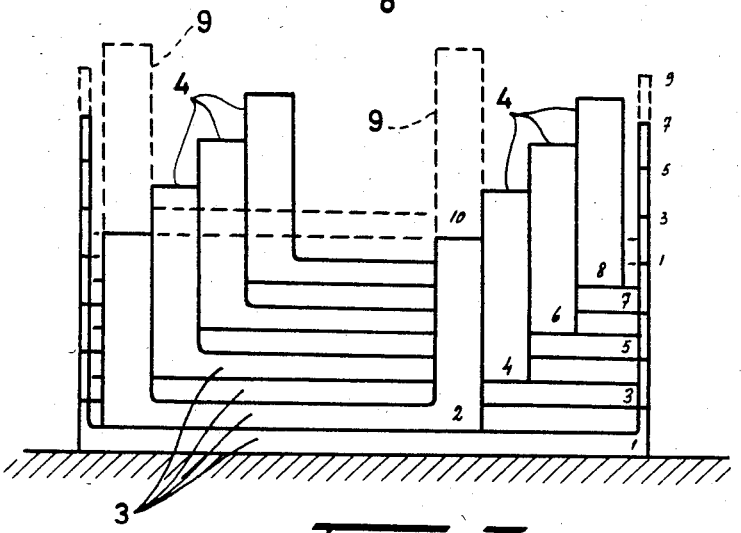
FIG. 3 is a diagram showing eight carriers stacked into each other at a given column height, while the same pattern can be continued in a subsequent stacking.

As already indicated herebefore the height h of support bottom part 1 should be measured across the place where a subsequent carrier is disposed transversely on the bottom part. The upright edges 3, therefor, need not have the same height all round but may be higher at the short sides of the rectangular carrier or crate, as shown by broken line 7. The elevated part, however, may not exceed the height h. The same applies to the long side of the rectangular carrier or crate, where the upright edges merge, near the columns, into obliquely extending support members 8 for the columns. Given the correct ratio of height h and height H of the columns, and with given length and width dimensions for the carrier, a large number of carriers or crates can be nested into each other alternately. FIG. 3 illustrates, e.g. eight carriers, being stacked according to the invention. Stacking carriers or crates in this way can be continued in the same manner (see the broken line 9 in FIG. 3).

A practically square bottom part can also be stacked, only the length of the carrier or crate needing to be twice the thickness of a column 4 larger. In that case, the set-back parts are disposed on all four sides of the bottom.

What is claimed is:

1. A plurality of rectangular trays for alternate transverse stacking one upon another each tray comprising (a) a rectangular bottom having upstanding side and end walls of the same vertical height, (b) four flat walled rectangular posts upstanding in pairs from each end of said end walls, (c) the height of said posts being of a multiple of the height of said side and end walls of a tray, (d) a flat walled handle extending from the outside of each end wall and lying intermediate said flat walled rectangular posts, and (e) the space between said flat walled handle and said rectangular posts defining a cutout to provide a sliding interlock between a flat wall of said handle and one wall of said flat walled corner posts to assure an interlocked vertical nested alternately transversely disposed stack of trays for transport facilitating quick and easy removal of the trays from the stack.

2. Stackable carrier according to claim 1, wherein the external distance between two opposite sides of the bottom part adjacent the rectangular corner post, is practically equal to or less than the internal distance between two corner posts measured between the same opposite sides.

3. Stackable plastic carrier for goods or articles, more particularly a plastic crate as claimed in claim 1, wherein said support bottom part provided near the corner of the post, the said and end walls of said support bottom part being provided with a cutout at least at two opposite sides near each post, each set-back part corresponding at least to the transverse dimensions of a corner column situated at that point.

4. Stackable carrier according to claim 3, wherein the cutout part at each opposite side of one post extends continuously from one post to the other post.

5. Stackable plastic carrier for goods or articles, more particularly a plastic crate as claimed in claim 1, wherein said support bottom part has upright post at the corners thereof, which upright post and support bottom part are made as a single plastic moulding, the columns on opposite sides being so disposed externally against the support bottom part that here is space available adjacent the columns at these opposite sides to receive free column ends of a carrier or crate disposed therebeneath in staggered relationship.

6. Stackable carrier according to claim 1, wherein the post are provided, at their bottoms, with connecting members which can engage around the top ends of post of a similar carrier or crate disposed therebeneath.

7. Stackable carrier according to claim 1, the post having a rectangular transverse periphery, their maximum transverse dimension being parallel to those sides of the support bottom part where the cutout parts are disposed.

8. Stackable carrier according to claim 1, wherein the carrier comprises at least one of the following features:

the base of the bottom part has a rectangular pattern and the short side is at least (the multiple/2+1) times the column width;

the base of the bottom part has a rectangular pattern and the long side is at least equal to the width of the carrier or crate+(the multiple/2−1) times the column width;

the support bottom part is provided with an upright edge(s), said upright edge(s) being provided with correspondingly set-back parts.

9. Stackable carrier according to claim 3, wherein the base of the bottom part is practically square and the cutout parts are disposed on all four sides of the bottom.

* * * * *